US010770040B1

(12) United States Patent
Lillywhite et al.

(10) Patent No.: US 10,770,040 B1
(45) Date of Patent: Sep. 8, 2020

(54) SAXOPHONE

(71) Applicant: Cannonball Musical Instruments, LLC, Sandy, UT (US)

(72) Inventors: Ryan Lillywhite, Sandy, UT (US); Tevis Laukat, Sandy, UT (US); Randal Clark, Herriman, UT (US); Sheryl Laukat, Sandy, UT (US)

(73) Assignee: CANNONBALL MUSICAL INTRUMENTS, LLC, Sandy, UT (US)

( * ) Notice: Subject to any disclaimer, the term of this patent is extended or adjusted under 35 U.S.C. 154(b) by 0 days.

(21) Appl. No.: 16/653,505

(22) Filed: Oct. 15, 2019

(51) Int. Cl.
*G10D 7/08* (2006.01)
*G10D 9/00* (2020.01)

(52) U.S. Cl.
CPC ..... *G10D 7/08* (2013.01); *G10D 9/00* (2013.01)

(58) Field of Classification Search
CPC ..... G10D 7/08; G10D 9/00
See application file for complete search history.

(56) References Cited

U.S. PATENT DOCUMENTS 1,487,482 A * 3/1924 Shane ..... G10D 9/00 84/385 R
5,000,072 A * 3/1991 Pascucci ..... G10D 9/00 84/380 R
9,230,521 B2 * 1/2016 Laukat ..... G10D 7/066

* cited by examiner

*Primary Examiner* — Robert W Horn
(74) *Attorney, Agent, or Firm* — Scarinci Hollenbeck, LLC; Libby Babu Varghese

(57) ABSTRACT

A woodwind instrument with improved tonal characteristics that plays both in-tune and with a timbre consistent with the rest of the range of notes. The instrument may be an improved saxophone having a tone hole on at least one joined section of the saxophone. The joined section may be a joint between a saxophone body and a upper bow, a joint between a saxophone body and lower bow or both. A connecting ring may be used at the joined section and, if used, will receive the tone hole. A method of improving the tonal characteristics of a saxophone comprises the steps of identifying at least one joint between two sections on said saxophone and soldering a tone hole at the joint. A connecting ring may be soft soldered to the joint.

16 Claims, 3 Drawing Sheets

SAXOPHONE

FIELD OF THE INVENTION

The present invention relates generally to saxophones, particularly to saxophones with improved tonal characteristics.

BACKGROUND OF THE INVENTION

Great pitch is crucial to playing instruments at high levels. In wind instruments, tone holes are used to adjust pitch. Tone holes may be stopped by a finger or a key to change the pitch of the tone created. In saxophones, for example, tone holes are traditionally placed within a continuous section of tube. The tube may be the musical instrument's body, bow, bell, or other section. More specifically, tone holes traditionally exist in the body, bow, and bell of a saxophone.

With regard to saxophones, baritone saxophones have been traditionally difficult to play in-tune. A baritone saxophone does not exist that plays both in-tune and with a timbre consistent with the rest of the range of notes. In select prior art examples of instruments, tone holes are shown to exist in the joint tenon of a clarinet. A tone hole on the joint tenon of the clarinet must be lined up with a key on the adjacent and neighboring clarinet body part. In another rare prior art saxophone to LeBlanc, a tone hole chimney is affixed to only one section, the body section, and the neighboring section, the bow section, has a U-shaped cutout where the tone hole chimney overlaps.

What is needed is an improved woodwind instrument, such as a saxophone, that allows a user to play in-tune more precisely. What is needed is an improved saxophone that allows a user to play with a timbre consistent with the rest of the range of notes. What is further needed is a woodwind instrument such as a saxophone where a tone hole chimney is disposed or affixed on one joined section or joint. It is further desired to have a woodwind instrument such as a saxophone where a tone hole chimney is disposed or affixed to two joined sections or joints. It is also further desired to have a woodwind instrument such as a saxophone where a tone hole chimney is disposed or affixed to a connecting ring covering part of both sections, specifically covering a joint between an end of one section and an end of the adjacent, adjoining, neighboring section.

SUMMARY OF THE INVENTION

A woodwind instrument with improved tonal characteristics of the present invention may include a saxophone such as a baritone saxophone, an alto, a tenor, a C melody bass, and soprano saxophone. The woodwind instrument disposes a tone hole at a joint between two sections of the instrument. In another embodiment, the tone hole is disposed at least at two joints. In yet another embodiment, the tone hole is disposed on a connecting ring disposed at a joint between two adjacent and adjoining sections.

An improved saxophone 100 of the present invention provides a tone hole 200 on at least one joint 210, 220 of the saxophone 100. The joint 210, 220 is between adjoining sections of the saxophone which defines a joined section. The tone hole 200 can be either on a connecting ring that covers the joint or on a soldering point that joins the two different tubes. The connecting ring may be placed on the joint to then receive the tone hole. The connecting ring may be placed at the joint between a saxophone body and a saxophone upper bow and/or between a saxophone body and a saxophone lower bow. If, instead a connecting ring were not used, then the tone hole would be soldered directly at the joint between a saxophone body and a saxophone upper bow and/or between a saxophone body and a saxophone lower bow.

The saxophone with improved tonal characteristics is created by identifying at least one joint on the saxophone where an in-tune tone will be emitted and placing a tone hole on the joint, with or without a connecting ring being disposed at the joint. The connecting ring may be soft soldered at said joint and the tone hole may be silver soldered to said connecting ring.

DETAILED DESCRIPTION OF THE INVENTION

Figure 1:
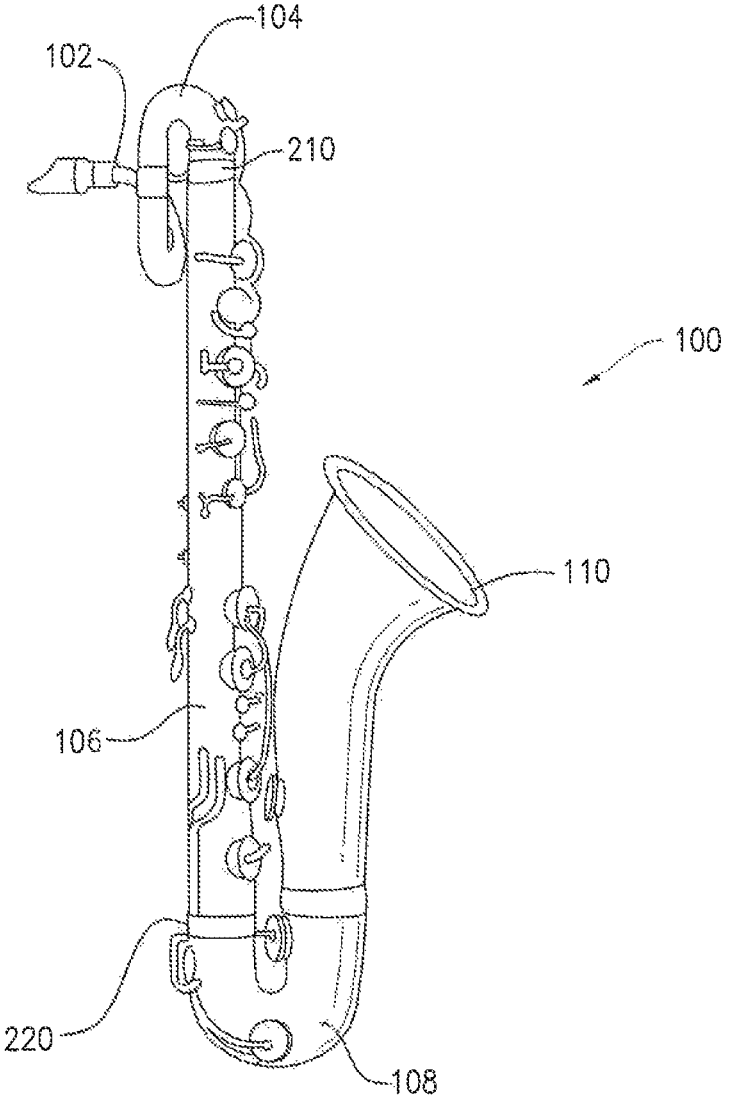
FIG. 1 shows an example of a woodwind instrument with improved tonal characteristics of the present invention.

An improved woodwind of the present invention may include a saxophone such as a baritone saxophone, an alto, a tenor, a C melody bass, and soprano saxophone. According to one embodiment of the present invention, FIG. 1 shows a woodwind instrument being a saxophone 100, specifically, a baritone saxophone. The woodwind instrument has sections including a neck 102, a body tube 106, a bow 108, and a bell 110. In the baritone saxophone 100 or even a bass saxophone there is an added section of an upper bow 104. Each section of the woodwind instrument has a joined section or joint, which is where ends of two adjacent and adjoining sections meet. In one non-limiting example, one joint may be where the end of an upper bow 104 section and the end of the adjacent and adjoining body tube 106 section meet.

The improved saxophone 100 of the present invention, however, provides a tone hole 200 or tone hole chimney on at least one point in the conical tube of the saxophone 100 where the tone hole 200 will emit an in-tune tone. In one embodiment of the present invention, the improved saxophone 100 of the present invention provides a tone hole 200 on at least one joint 210 or joined section of the saxophone. In contrast, traditional, prior art, saxophones employ tone holes on a continuous section of the saxophone such as the body, bow or other section. The location of the tone hole 200 differs according to the geometry of a given saxophone 100 and the desired note. In another embodiment of the present invention, the tone hole 200 will be located on at least two joints 210, 220. The joined section may be a joint 210 between saxophone body 106 and saxophone upper bow 104 and a joint 220 between saxophone body 106 and saxophone lower bow 108 or both.

Figure 2:
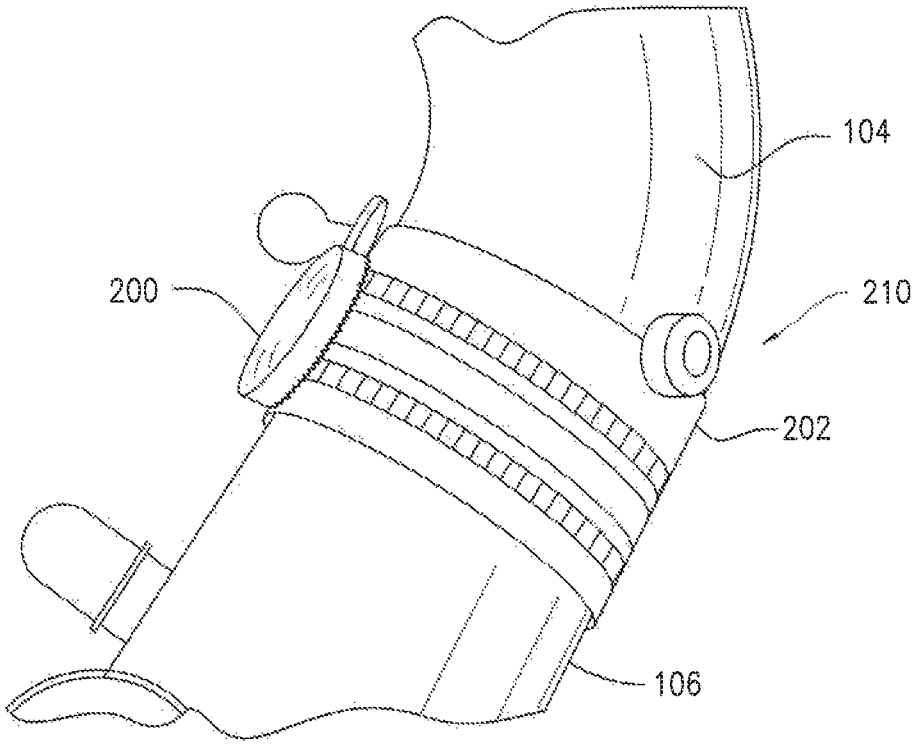
FIG. 2 shows a side view of the tone hole of the instrument of the present invention.

A joint ring or connecting ring 202 may be used at the joint 210, 220 and, if used, will receive the tone hole 200. FIG. 2 shows the tone hole 200 on the connecting ring 202 disposed at joint 210. In one embodiment, the tone hole 200 is permanently attached to the connecting ring 202. In another embodiment, the tone hole 200 is soldered to the ring 202 using silver solder. Joint 210, 220 are not intended to be separated but for when a repair is needed.

Figure 3:
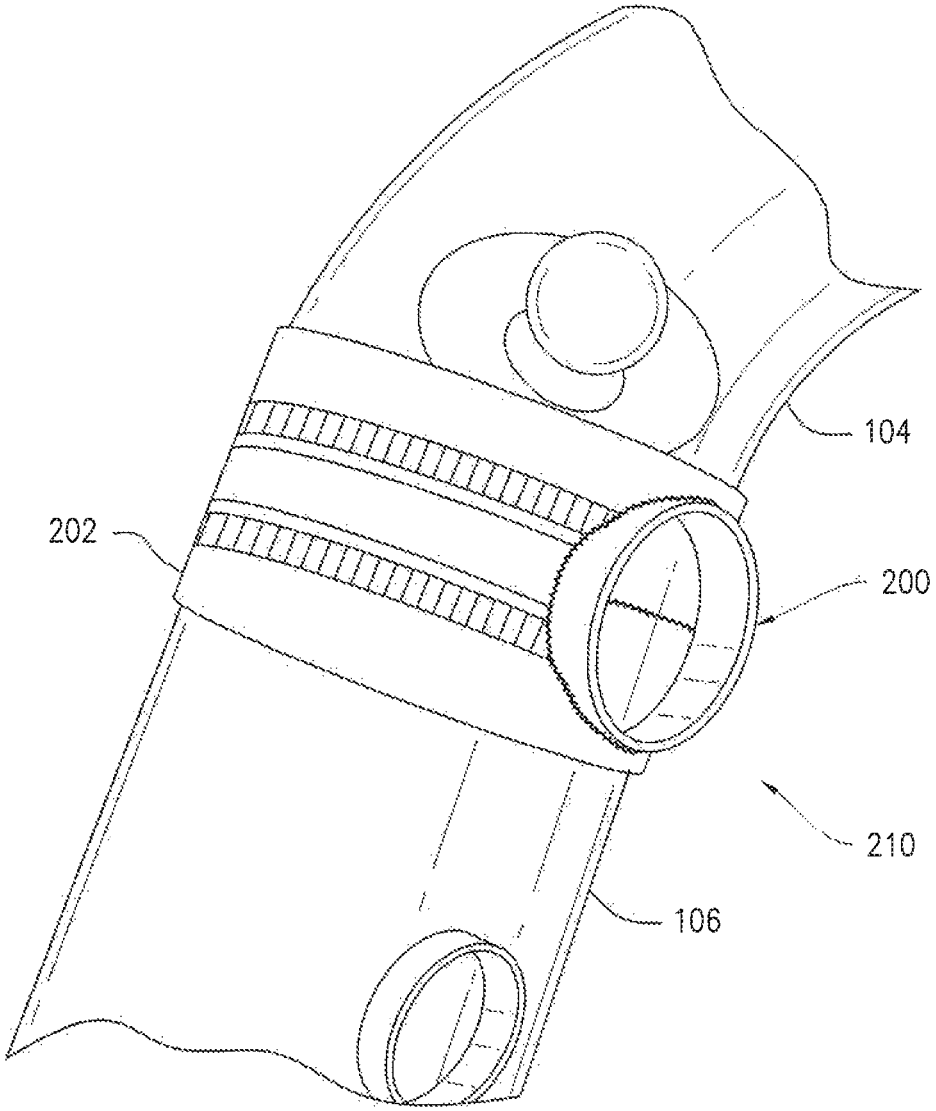
FIG. 3 shows an opposite side view of the tone hole of the instrument of the present invention further showing a view inside the tone hole.

FIGS. 2 and 3 show a High Eb tone hole 200 placed at joint 210 between ends of the body tube 106 and upper bow 104 sections. A soldered line is visible upon looking within the tone hole 200, which further shows that the tone hole 200 is disposed on the joint. See FIG. 3. The location of the High Eb tone hole permits the saxophone 100 to play in-tune. In one embodiment, the connecting ring 202 may be soldered at the joint using a semi-permanent soldering method. In another embodiment, is soft soldered at the joint. The connecting ring 202 spans two sections that form a joint and is thus integrated between two sections of the saxophone.

While specific embodiments of the invention have been described and illustrated, such embodiments should be considered illustrative of the invention only and not as limiting the invention as construed in accordance with the accompanying claims. One of ordinary skill in the art could alter the above embodiments or provide insubstantial changes that may be made without departing from the scope of the invention.

We claim:

1. A saxophone comprising a tone hole disposed on at least one joint of the saxophone.

2. The saxophone of claim 1, wherein ends of two adjacent and adjoining sections meet define said joint.

3. The saxophone of claim 1, wherein a connecting ring is disposed at said joint, said tone hole is disposed on said connecting ring.

4. The saxophone of claim 1, wherein said joint is between a saxophone body and a saxophone upper bow.

5. The saxophone of claim 1, wherein said joint is between a saxophone body and a saxophone lower bow.

6. The saxophone of claim 1, wherein the tone hole is disposed on at least a second joint of the saxophone.

7. The saxophone of claim 6, wherein said two joints are between a saxophone body and a saxophone upper bow and between a saxophone body and a saxophone lower bow.

8. The saxophone of claim 7, wherein a connecting ring is disposed at each said two joints, said tone hole is disposed on each said connecting ring.

9. A saxophone comprising a tone hole disposed on a connecting ring disposed on said saxophone.

10. The saxophone of claim 9, wherein said connecting ring is disposed on a joint between adjoining sections of said saxophone.

11. A method of improving the tonal characteristics of a saxophone comprising the steps of:

identifying at least one joint on the saxophone where an in-tune tone will be emitted; and disposing a tone hole at said joint.

12. The method of claim 11, wherein at least two joints are identified.

13. The method of claim 11, further comprising disposing a connecting ring at said joint, said tone hole is disposed on said connecting ring.

14. The method of claim 13, wherein said connecting ring is soft soldered at said joint.

15. The method of claim 13, wherein said tone hole is soldered to said connecting ring.

16. The method of claim 15, wherein said tone hole is silver soldered to said connecting ring.

* * * * *